US009599366B2

(12) United States Patent
Hoffert

(10) Patent No.: US 9,599,366 B2
(45) Date of Patent: Mar. 21, 2017

(54) FLAMELESS HEATER

(71) Applicant: Steve Hoffert, Leduc (CA)

(72) Inventor: Steve Hoffert, Leduc (CA)

( * ) Notice: Subject to any disclaimer, the term of this patent is extended or adjusted under 35 U.S.C. 154(b) by 1043 days.

(21) Appl. No.: 13/826,749

(22) Filed: Mar. 14, 2013

(65) Prior Publication Data

US 2015/0176859 A1 Jun. 25, 2015

Related U.S. Application Data

(60) Provisional application No. 61/611,194, filed on Mar. 15, 2012.

(51) Int. Cl.
*F24H 3/00* (2006.01)
*F24D 5/00* (2006.01)

(52) U.S. Cl.
CPC ..... *F24H 3/00* (2013.01); *F24D 5/00* (2013.01); *F24D 2200/18* (2013.01); *F24D 2200/26* (2013.01)

(58) Field of Classification Search
CPC ..... F24J 3/003; F24H 3/00
USPC ..... 237/12.1
See application file for complete search history.

(56) References Cited

U.S. PATENT DOCUMENTS 3,263,979 A 8/1966 Muckelrath
4,387,701 A * 6/1983 Gibbons ..... F24J 3/003 126/247
4,407,449 A * 10/1983 Moser ..... B60H 1/22 122/26
4,651,711 A 3/1987 Velie
4,728,029 A * 3/1988 Griebel ..... B60H 1/22 122/26
5,201,651 A 4/1993 Niksic et al.
6,138,666 A 10/2000 Hubbard
6,244,232 B1 * 6/2001 Ban ..... B60H 1/038 123/142.5 R
7,424,916 B2 * 9/2008 Foster ..... E21B 37/00 166/303
7,866,380 B2 * 1/2011 Masters ..... F24D 17/00 165/200
2002/0011524 A1 * 1/2002 Suzuki ..... B60H 1/03 237/19
2005/0082064 A1 * 4/2005 Foster ..... E21B 43/166 166/303

(Continued)

*Primary Examiner* — Avinash Savani
*Assistant Examiner* — Deepak Deean
(74) *Attorney, Agent, or Firm* — Robert C. Montgomery; Montgomery Patent & Design

(57) ABSTRACT

A flameless heater produces hot dry air utilizing hydraulic heat-transfer fluid as a heat transfer medium. The heater is powered preferably by a natural gas engine. The process begins with the natural gas engine producing rotary power which drives a hydraulic pump which directs the heat-transferring fluid through a dynamic heat generator to heat the fluid via an internal friction process. The heated fluid is subsequently circulated through a heat exchanger where a hydraulically-powered fan blows ambient air through to be heated. The heat exchanger also extracts heat from the exhaust and coolant system portions of the engine to further heat the air. The produced dry hot air may be used for general heating. It is envisioned that engines which utilize other fuel sources such as diesel, gasoline, steam, or the like could be utilized with equal effectiveness.

16 Claims, 1 Drawing Sheet

(56) References Cited

U.S. PATENT DOCUMENTS

| | | | | |
|---|---|---|---|---|
| 2005/0205682 | A1* | 9/2005 | Sanger | B60H 1/00314 237/10 |
| 2007/0261823 | A1* | 11/2007 | Masters | F24D 17/00 165/110 |
| 2009/0057434 | A1* | 3/2009 | Mustafaev | F24J 3/003 237/63 |
| 2010/0089340 | A1* | 4/2010 | Givens | F02B 63/04 123/2 |
| 2010/0154395 | A1* | 6/2010 | Frick | F01K 27/02 60/320 |
| 2010/0192875 | A1* | 8/2010 | Frick | F22B 27/04 122/26 |
| 2010/0194111 | A1* | 8/2010 | Van Den Bossche | F01K 3/247 290/2 |
| 2011/0005757 | A1* | 1/2011 | Hebert | E21B 36/006 166/302 |
| 2012/0048717 | A1* | 3/2012 | Frick | F01K 27/02 203/22 |
| 2012/0174987 | A1* | 7/2012 | Crawford | B08B 9/027 137/15.04 |
| 2013/0075245 | A1* | 3/2013 | Frick | B01D 1/0047 203/22 |
| 2013/0284817 | A1* | 10/2013 | Welle | F24H 1/06 237/12.1 |

* cited by examiner

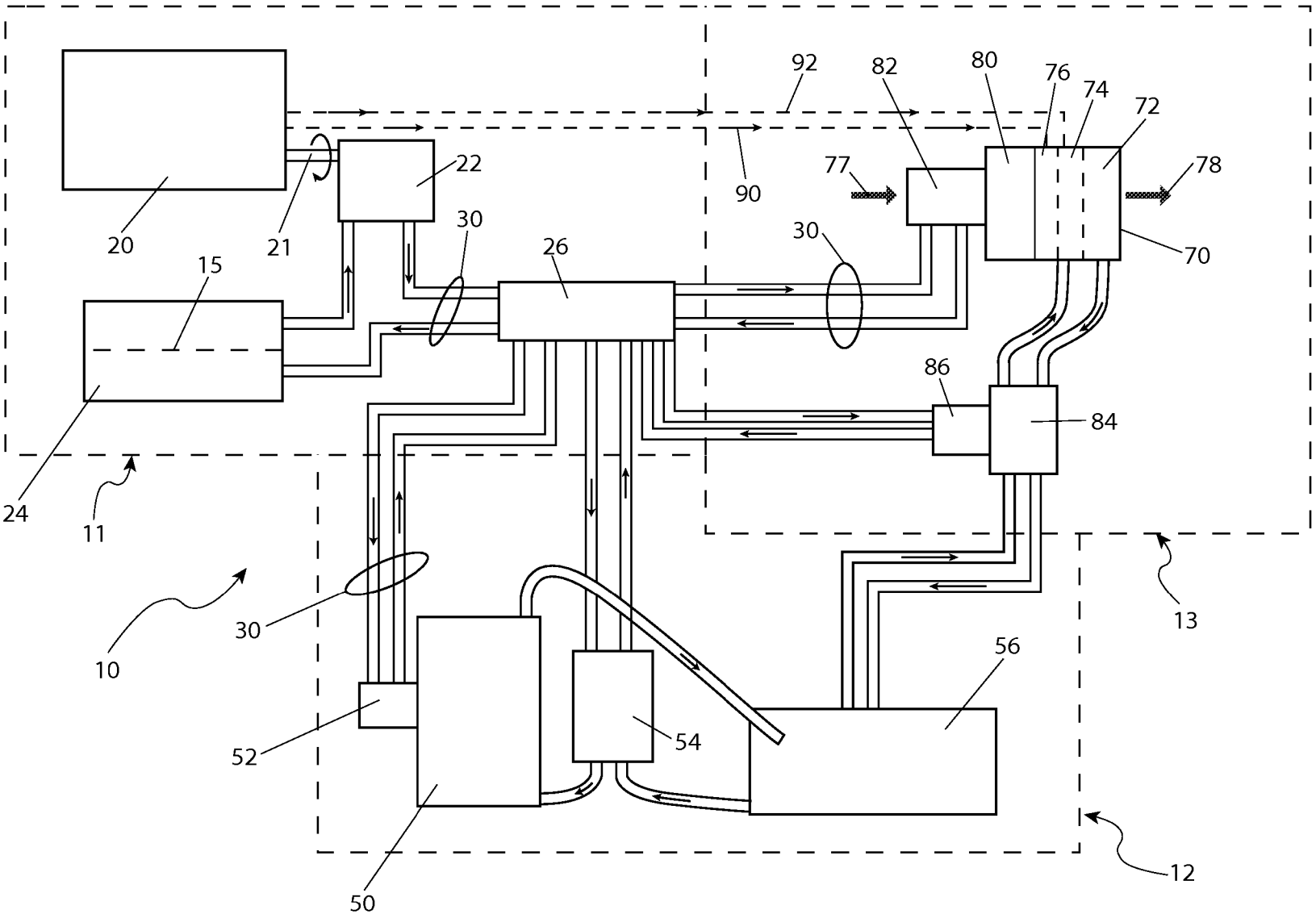
78
70
72
74
76
80
82
77
92
90
30
13
84
86
12
56
54
26
22
30
21
20
15
24
11
10
30
52
50

FLAMELESS HEATER

RELATED APPLICATIONS

The present invention was first described in and claims the benefit of U.S. Provisional Patent Application No. 61/611,194 filed on Mar. 15, 2012, the entire disclosures of which are incorporated herein by reference.

FIELD OF THE INVENTION

The present invention relates to system for providing a flameless means for heating a flow of air, further including a heat transfer fluid supply section, a heating section for heating the heat transfer fluid, and a heat exchanger section for transferring heat from the heated transfer fluid to the flow of air.

BACKGROUND OF THE INVENTION

Providing heat for general warmth has been a concern since the dawn of mankind. Various methods and devices have been constructed to provide heat for man in his home, workplace, and for general recreation. Technological advancements for heaters focused mostly on safety, efficiency, and providing clean forms of energy. A common method of generating heat is combustion of a fuel. Fossil fuels are abundant and vast networks have been devised to process, store, and supply fossil fuels at a considerably safe and cost effective manner. Tapping processed fossil fuels from provided-for supplies, is easy, effective, and efficient. However, generating heat from combustion typically requires an open flame process. Several situations dictate that open flame heating is unsafe, impracticable, or just not conducive to the operation at hand. An example of such a situation is a construction field site of a gas or oil extraction operation. Flameless heaters provide the benefits of generating heat without the risks associated with an open flame.

There are several methods to generate heat without an open flame; however, when generating heat, cost efficiency is a major concern. In this regard, the cost of heating can be considerably reduced by exploiting the readily-available fuel that is relatively abundant. It is desirable to provide a heat generator that exploits the readily available fuel of oil exhibiting adequate specific heat and heat transfer properties. It is further desirable to provide a heat generator that does not expel combustion by-products to the immediate work area. It is further desirable to provide a heater that does not necessitate excessive capital expenditures or operational costs.

SUMMARY OF THE INVENTION

The present invention relates to a flameless heater for producing warm air. The system comprises a pressurized fluid supply section, a fluid heating section, a blower fan, and a heat exchanger section. The fluid supply section pressurizes and directs incoming heat-transfer fluid from a valve bank. The fluid supply section is provided with an engine or motor to provide rotary power to a hydraulic pump. The first hydraulic pump is mechanically connected to and driven by the engine, and provides mechanical rotation of a dynamic heat generator. The rotation of the dynamic heat generator heats the heat-transfer fluid via a shearing friction process. A second hydraulic pump circulates fluid from a heated fluid reservoir and through the dynamic heat generator. A third hydraulic pump driven by a third hydraulic motor provides a means to transfer the heated heat-transfer fluid to a heat exchanger portion of the heat exchanger section where it heats an ambient air flow passing through the heat exchanger. The heat exchanger section is also in connection with a cooling system line portion of the engine for circulating engine cooling fluid through the heat exchanger for additional heat being imparted into the air flow. The heat exchanger section is further connected to an exhaust system line of the engine for circulating hot engine exhaust gases through the heat exchanger to further heat the air flow. The air flow is forced through the heat exchanger by the fan blower. The airflow generated from the fan is blown over the heat exchanger to produce a clean dry heated air flow for the purposes of general area heating.

Once the engine is activated, power is supplied to the first hydraulic pump, which circulates pressurized heat-transfer fluid through the valve bank. The valve bank directs the pressurized heat-transfer fluid to the first hydraulic motor to rotate the dynamic heat generator, which generates heat flamelessly. The heat laden fluid is then directed through a heat exchanger to transfer heat from then fluid to air also passing through the heat exchanger. The warmed air is then forced in a desired direction with the use of a fan blower. The efficiency of the system is increased by further utilizing the waste heat of the engine and fluids of the coolant system to impart additional heat into the heat exchanger.

The development of the present invention affords the ability to exploit the abundance of heat-transfer fluids at a construction field site of a gas or oil extraction operation to generate a flameless and clean form of heat energy.

BRIEF DESCRIPTION OF THE DRAWING

The advantages and features of the present invention will become better understood with reference to the following more detailed description and claims taken in conjunction with the accompanying drawings in which like elements are identified with like symbols and in which:

FIG. 1 is a functional diagram which illustrates a flameless heater 10 for producing warmed dry air 78, in accordance with the present invention.

DESCRIPTIVE KEY

10 flameless heater
11 supply section
12 heating section
13 heat exchanger section
15 heat-transfer fluid
20 engine
21 driving means
22 first hydraulic pump
24 supply fluid reservoir
26 valve bank
30 hydraulic line
50 dynamic heat generator
52 first hydraulic motor
54 second hydraulic pump
56 heated fluid reservoir
70 heat exchanger
72 first chamber
74 second chamber
76 third chamber
77 air flow
78 heated air flow
80 fan
82 second hydraulic motor

84 third hydraulic pump
86 third hydraulic motor
90 exhaust system line
92 cooling system line

DETAILED DESCRIPTION OF THE PREFERRED EMBODIMENT

The best mode for carrying out the invention is presented in terms of its preferred embodiment, herein depicted within FIG. 1. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, a functional diagram which illustrates a flameless heater for producing warmed, dry air (herein described as the "system") 10, according to the preferred embodiment of the present invention, is disclosed. The system 10 comprises a pressurized fluid supply section 11, a fluid heating section 12, and a heat exchanger section 13 to produce a clean warmed and dry air flow 78.

The supply section 11 provides a pressurization and flow means to a volume of heat-transfer fluid 15 being supplied via hydraulic lines 30 to a commercially-available hydraulic valve bank 26. The valve bank 26 comprises a plurality of electrically-actuated valve portions to direct pressurized heat-transfer fluid 15 to various hydraulic pumps and motors within the system 10.

The supply section 11 includes at least one (1) engine 20 for providing rotary power to a first hydraulic pump 22. In the preferred embodiment, the engine 20 is a natural gas powered internal-combustion engine which produces rotary power through the burning of natural gas. It can be appreciated that the engine 20 can also be any other suitable engine type, such as, but not limited to: diesel, gasoline, or steam; furthermore, an electric motor may also be utilized to provide said rotary power to the system 10 with equal benefit, and as such should not be interpreted as a limiting factor of the system 10. The first hydraulic pump 22 is mechanically connected to and driven by a drive means of the engine 20. The first hydraulic pump 22 can be any suitable type of hydrostatic or hydrodynamic pump, including gear, rotary, or screw-type pump. The driving means 21 is envisioned to be an output shaft of the engine 20, or alternately, a belt or gear transmission assembly for correct transferring of power with equal benefit; as such, the type of driving means should not be interpreted as a limiting factor of the system 10. A hydraulic line 30 conveys the pressurized heat transfer fluid 15 from the first hydraulic pump 22 to the valve bank 26 which provides regulated distribution of said heat-transfer fluid 15 to the remaining sections 12, 13 of the system 10. The supply section 11 further comprises a supply fluid reservoir 24 which stores a volume of heat-transfer fluid 15 for normal fluid supply and return functions to the first hydraulic pump 22. The heat-transfer fluid 15 is envisioned to be similar to products produced by PRO-CANADA®, or equivalent fluid products. It is understood that the hydraulic supply section 11 along with the valve bank 26 may be sized and configured to provide regulated hydraulic fluid service to various permanently and temporarily attached hydraulically-powered peripheral equipment associated with various job and work sites.

The valve bank 26 supplies a flow of heat-transfer fluid 15 to a first hydraulic motor portion 52 of the heating section 12, to provide a driving force which in turn provides mechanical rotation of a dynamic heat generator 50. The rotation of the dynamic heat generator 50 in turn heats the heat-transfer fluid 15 via a shearing friction process. The dynamic heat generator 50 is envisioned to be similar to units manufactured by ISLAND CITY®, being capable of providing approximately six-hundred fifty thousand (650,000) BTUs per hour of heat. The dynamic heat generator 50 is capable of heating large fluid volumes rapidly and efficiently without a heat exchanger. A second hydraulic pump 54 circulates fluid 15 from a heated fluid reservoir 56; through the dynamic heat generator 50; and, back to the heated fluid reservoir 56. The second hydraulic pump 54 is driven by a flow of heat-transfer fluid 15 from the valve bank 26 via hydraulic lines 30. A sufficient volume of heated heat-transfer fluid 15 is to be maintained within the heated fluid reservoir 56 for circulation through the heat exchanger section 13.

A third hydraulic pump 84 driven by a third hydraulic motor 86 provides a means to transfer the heated heat-transfer fluid 15 from the heated fluid reservoir 56 through the heat exchanger portion 70 of the heat exchanger section 13 where it heats an ambient air flow 77 passing through the heat exchanger 70. The heat exchanger 70 includes three (3) discrete heat exchanger chambers, including a first chamber 72, a second chamber 74, and a third chamber 76. Each chamber 72, 74, 76 preferably includes a heat exchanger coil tube for circulating available heated fluids and gases to heat the air flow 77. The inlet and outlet lines 30 of the first chamber 72 are connected to the third hydraulic pump 84 which circulates the heated heat-transfer fluid 15 from the heated fluid reservoir 56 through the heat exchanger 70. When used in conjunction with a water-cooled internal combustion-type engine 20, the second chamber 74 is connected to a cooling system line portion 92 of the engine 20 for circulating engine cooling fluid through the heat exchanger 70 to further heat the air flow 77. Also, when used in conjunction with a water-cooled internal combustion-type engine 20, the third chamber 76 is connected to an exhaust system line 90 of the engine 20 for circulating hot engine exhaust gases through the heat exchanger 70 to further heat the air flow 77.

The air flow 77 is propelled through the heat exchanger 70 via mechanical connection to the fan 80 preferably being powered by a second hydraulic motor 82 which provides a rotary output to shaft and impeller portions of the fan 27.

The air flow 77 generated from the fan 27 is blown over each of the heat exchanger chambers 72, 74, 76 to produce a clean dry heated air flow 78 for the purposes of general area heating; however, it is understood that said heated air flow 78 may be ducted or otherwise conveyed to a location where heating is needed. Such heated air flow 78 can be used for almost any heating purpose, but is viewed as especially beneficial for the oil and gas industry on construction fields. All of the hydraulic components of the system 10 are interconnected with hydraulic lines, hoses, or the like, as required. The system 10 is preferably designed with all functional components housed within a single enclosure. The system 10 can be manufactured in various sizes which produce proportional amounts of heated air. The use of the system 10 provides a continuous supply of heated air 78 in a simple package that is efficient to use.

The materials required to produce the system 10 are all readily available and well known to manufacturers of goods of this type. The heat exchanger 70 is preferably made of various metals in a metal casting, machining, and soldering process. The skills of a mechanical design team would be necessary to size all mechanical components of the system 10 and ensure proper interface, operation, and thermal energy transfer properties. The hydraulic pumps 22, 54, 84 can be any suitable type of hydrostatic or hydrodynamic pump, including gear, rotary, or screw-type pump. The various discrete components used in the system 10 such as the engine 20, the hydraulic pumps 22, 54, 84, hydraulic motors 52, 82, 86, the dynamic heat generator 50, the hydraulically powered fan 80, hydraulic hoses 30, and the like, would best be suited for procurement from wholesalers and manufacturers that deal in goods of that nature. The relatively simple design of the various components and the materials of construction make the system 10 a cost-effective design due to the relatively low material and labor costs involved. Production of the system 10 will be performed by manufacturing workers of average skill.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of utilizing the system 10 may be achieved by performing the following steps: procuring a model of the system 10 which produces a desired volume of heated air flow 78; providing necessary fuel to the engine 20; starting the engine 20 to power the first hydraulic pump 22 to circulate pressurized heat-transfer fluid 15 through the valve bank 26; utilizing the valve bank 26 to direct pressurized heat-transfer fluid 15 to the first hydraulic motor 52 to rotate the dynamic heat generator 50; heating the heat-transfer fluid 15 via said dynamic heat generator 50, to a predetermined temperature without utilizing flames or other polluting methods; circulating and storing a volume of heated heat-transfer fluid 15 into the heated fluid reservoir 56 for subsequent use in the heat exchanger section 13 using the second hydraulic pump 54; transferring the heated heat-transfer fluid 15 from the heated fluid reservoir 56 through the third chamber 76 of the heat exchanger 70 using the third hydraulic pump 84; heating the air flow 77 being propelled through the heat exchanger 70 via the fan 80; utilizing waste heat from the engine 20 by circulating gasses from an exhaust system line 90 and fluids from a coolant system line 92 through first 72 and second 74 chambers of the heat exchanger 70, respectively, to further heat the air flow 77; and, benefiting from a supply of clean heated air flow 78 afforded a user of the present system 10.

The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A system for heating a flow of air, comprising:

a supply section, comprising:

a first reservoir retaining a first volume of a heat transfer fluid;

at least one prime mover in mechanical communication with a first driving means;

a first hydraulic pump in mechanical communication with said first driving means, said first hydraulic pump in fluid communication with said first reservoir; and, a valve bank in fluid communication with said first hydraulic pump;

wherein said at least one prime mover drives said first hydraulic pump to transfer said heat transfer fluid from said first reservoir and transfer said heat transfer fluid to said valve bank;

a heating section, comprising:

a second reservoir retaining a second volume of said heat transfer fluid;

a first hydraulic motor in fluid communication with said valve bank;

a second hydraulic pump in mechanical communication with a second driving means in fluid communication with said valve bank, said second hydraulic pump in fluid communication with said second reservoir; and, a dynamic heat generator in mechanical communication with said first hydraulic motor and in fluid communication with said second hydraulic pump and said second reservoir;

wherein said valve bank transfers said heat transfer fluid to said first hydraulic motor to provide a first driving force thereto;

wherein said valve bank transfers said heat transfer fluid to said second driving means of said second hydraulic pump to provide a second driving force thereto;

wherein said second hydraulic pump transfers said heat transfer fluid from said second reservoir to said dynamic heat generator;

wherein said first hydraulic motor drives said dynamic heat generator to heat said heat transfer fluid; and, wherein said dynamic heat generator generates heated heat transfer fluid and transfers said heated heat transfer fluid to said second reservoir; and, a heat exchanger section in fluid communication with said second reservoir and said valve bank;

wherein said valve bank transfers said heat transfer fluid to said heating section and said heat exchanger section;

wherein said second reservoir transfers said heated heat transfer fluid to said heat exchanger section;

wherein said heat exchanger section transfers heat from said heated heat transfer fluid delivered by said heating section to said flow of air; and, wherein said system provided a flameless means of heating said flow of air.

2. The system of claim 1, wherein said at least one prime mover is a natural gas powered internal-combustion engine.

3. The system of claim 1, wherein said valve bank further comprises a plurality of electrically-actuated valves.

4. The system of claim 1, wherein said dynamic heat generator is capable of providing approximately 650,000 BTU's per hour.

5. The system of claim 1, wherein said heat exchanger section further comprises:

a second hydraulic motor in fluid communication with said valve bank;

a fan operably controlled by and in mechanical communication with said second hydraulic motor;

a third hydraulic pump having a third driving means in fluid communication with said valve bank, said third hydraulic pump in fluid communication with said second reservoir; and, a heat exchanger in fluid communication with said third hydraulic pump;

wherein said valve bank transfers said heat transfer fluid to said second hydraulic motor to provide a third driving force thereto;

wherein said valve bank transfers said heat transfer fluid to said third driving means of said third hydraulic pump to provide a fourth driving force thereto;

wherein said third hydraulic pump transfers said heated heat transfer fluid from said second reservoir to said heat exchanger;

wherein said fan is driven by said second hydraulic motor, generates said flow of air, and directs said flow of air to said heat exchanger; and, wherein said heated heat transfer fluid within said heat exchanger transfers heat to said flow of air.

6. The system of claim 5, wherein heat exchanger further comprises three discrete heat exchanger chambers arranged in a series, each comprising a heat exchanger coil tube for circulating said heated heat transfer fluid to heat said flow of air.

7. The system of claim 6, wherein said supply section, said heating section, and said heat exchanger section are provided within a single enclosure.

8. A system for heating a flow of air, comprising:

a supply section, comprising:

a first reservoir retaining a first volume of a heat transfer fluid;

at least one prime mover in mechanical communication with a first driving means;

a first hydraulic pump in mechanical communication with said first driving means, said first hydraulic pump in fluid communication with said first reservoir; and, a valve bank in fluid communication with said first hydraulic pump;

wherein said at least one prime mover drives said first hydraulic pump to transfer said heat transfer fluid from said first reservoir and transfer said heat transfer fluid to said valve bank;

a heating section, comprising:

a second reservoir retaining a second volume of said heat transfer fluid;

a first hydraulic motor in fluid communication with said valve bank;

a second hydraulic pump in mechanical communication with a second driving means in fluid communication with said valve bank, said second hydraulic pump in fluid communication with said second reservoir; and, a dynamic heat generator in mechanical communication with said first hydraulic motor and in fluid communication with said second hydraulic pump and said second reservoir;

wherein said valve bank transfers said heat transfer fluid to said first hydraulic motor to provide a first driving force thereto;

wherein said valve bank transfers said heat transfer fluid to said second driving means of said second hydraulic pump to provide a second driving force thereto;

wherein said second hydraulic pump transfers said heat transfer fluid from said second reservoir to said dynamic heat generator;

wherein said first hydraulic motor drives said dynamic heat generator to heat said heat transfer fluid; and, wherein said dynamic heat generator generates heated heat transfer fluid and transfers said heated heat transfer fluid to said second reservoir; and, a heat exchanger section in fluid communication with said second reservoir and said valve bank;

wherein said valve bank transfers said heat transfer fluid to said heating section and said heat exchanger section;

wherein said second reservoir transfers said heated heat transfer fluid to said heat exchanger section;

wherein said heat exchanger section transfers heat from said heated heat transfer fluid delivered by said heating section to said flow of air;

wherein said heat exchanger section transfers heat generated by at least one auxiliary source within said supply section to said flow of air; and, wherein said system provided a flameless means of heating said flow of air.

9. The system of claim 8, wherein said at least one prime mover is a natural gas powered internal-combustion engine.

10. The system of claim 8, wherein said valve bank further comprises a plurality of electrically-actuated valves.

11. The system of claim 8, wherein said dynamic heat generator is capable of providing approximately 650,000 BTU's per hour.

12. The system of claim 8, wherein said heat exchanger section further comprises:

a second hydraulic motor in fluid communication with said valve bank;

a fan operably controlled by and in mechanical communication with said second hydraulic motor;

a third hydraulic pump having a third driving means in fluid communication with said valve bank, said third hydraulic pump in fluid communication with said second reservoir; and, a heat exchanger in fluid communication with said third hydraulic pump;

wherein said valve bank transfers said heat transfer fluid to said second hydraulic motor to provide a third driving force thereto;

wherein said valve bank transfers said heat transfer fluid to said third driving means of said third hydraulic pump to provide a fourth driving force thereto;

wherein said third hydraulic pump transfers said heated heat transfer fluid from said second reservoir to said heat exchanger;

wherein said fan is driven by said second hydraulic motor, generates said flow of air, and directs said flow of air to said heat exchanger; and, wherein said heated heat transfer fluid within said heat exchanger transfers heat to said flow of air.

13. The system of claim 12, wherein heat exchanger further comprises three discrete heat exchanger chambers arranged in a series, each comprising a heat exchanger coil tube for circulating said heated heat transfer fluid to heat said flow of air.

14. The system of claim 13, wherein:

a first chamber is in fluid communication with said third hydraulic pump;

a second chamber downstream from said first chamber, further in fluid communication with said at least one auxiliary source; and, a third chamber downstream from said second chamber, further in fluid communication with said at least one auxiliary source;

wherein said heated heat transfer fluid transfers heat to said flow of air; and, wherein said at least one auxiliary source transfers heat to said flow of air.

15. The system of claim 14, wherein said at least one auxiliary source further comprises:

a cooling system line from said at least one prime mover; and, an exhaust system line of said at least one prime mover.

16. The system of claim 15, wherein said supply section, said heating section, and said heat exchanger section are provided within a single enclosure.

* * * * *